United States Patent [19]

Thomas et al.

[11] 3,991,908

[45] Nov. 16, 1976

[54] PILL DISPENSER

[75] Inventors: Michael D. Thomas, Elmhurst; Francis E. Ryder, Barrington, both of Ill.

[73] Assignee: Ryder International Corporation, Schaumburg, Ill.

[22] Filed: June 27, 1975

[21] Appl. No.: 591,176

[52] U.S. Cl. ..... 221/154; 215/218; 151/9; 221/265; 222/153; 222/370

[51] Int. Cl.[2] ..... A47F 1/04

[58] Field of Search ..... 222/344, 565, 345, 83.5, 222/367, 370, 452, 450, 153; 221/263–265, 154; 215/330, 216, 218–221; 206/528, 540; 151/9, 10, 11

[56] References Cited

UNITED STATES PATENTS

| | | | |
|---|---|---|---|
| 1,717,025 | 6/1929 | Green | 222/370 |
| 2,630,245 | 3/1953 | Maier | 221/265 |
| 2,729,366 | 1/1956 | Chadwick | 222/370 |
| 2,828,005 | 3/1958 | Ricke | 221/89 |
| 2,869,747 | 1/1959 | Patterson | 215/330 |
| 3,730,387 | 5/1973 | McConnell et al. | 221/265 |
| 3,840,136 | 10/1974 | Lanfranconi et al. | 222/83.5 |

*Primary Examiner*—Robert B. Reeves
*Assistant Examiner*—H. Grant Skaggs
*Attorney, Agent, or Firm*—Olson, Trexler, Wolters, Bushnell & Fosse, Ltd.

[57] ABSTRACT

There is disclosed a pill dispensing cap assembly device adapted for mounting on the neck of a pill container. The cap assembly device is designed to provide for the effective and efficient dispensing of pills which are randomly stored in a container, upon rotation of one element of the cap assembly, through a rather limited arc. The cap assembly includes a cap member secured to the neck of the container and having a discharge passage in communication with the interior of the container; fixed with respect to the cap member is a cover element having one or more dispensing openings therein, which are offset relative to the cap member discharge opening. Mounted between the cap member and the cover element is a rotor member adapted for rotation relative to the cap member and cover element and having a pill receiving aperture therein. As such, when the pill receiving aperture of said rotor is aligned with the discharge opening of the cap member the bottom of said aperture will be closed by surface of said cover element. As such, a pill can be picked up by the rotor member and transferred to a point wherein it is in alignment with a dispensing opening formed in the cover member whereupon said pill can drop from the cap assembly. The surfaces of the rotor member adjacent the rotor aperture or apertures are sloped in such a manner that these surfaces will serve to cam any excess pills back into the discharge opening, upon movement of the rotor element during the dispensing operation.

11 Claims, 16 Drawing Figures

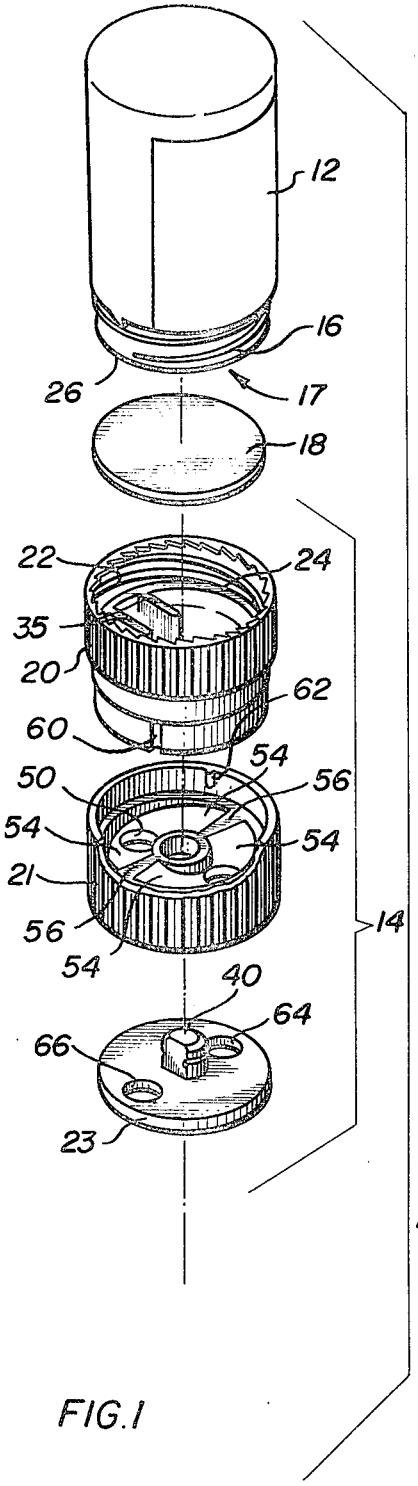
FIG.1
FIG.3
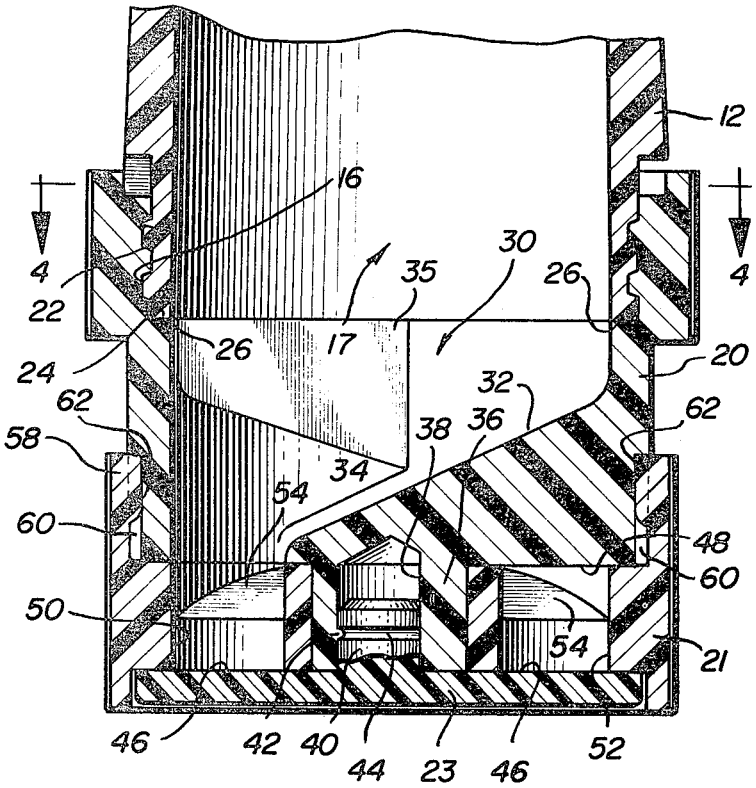
FIG.2
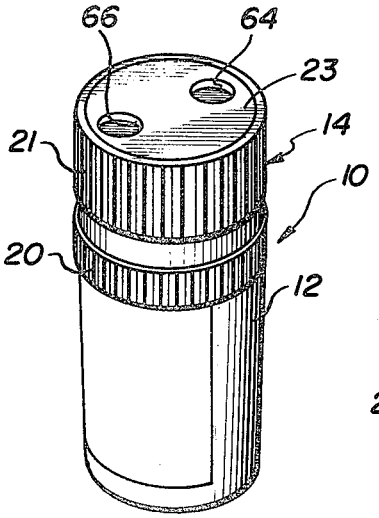
FIG.4
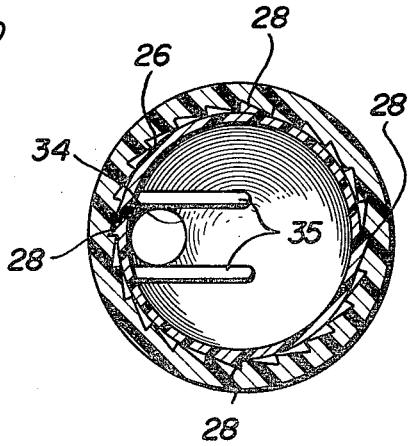

PILL DISPENSER

BACKGROUND OF THE INVENTION

The present invention relates to pill dispensers, and more specifically is concerned with a novel dispensing device that can be employed as a cap assembly for a bottle or pill container, and can be assembled incident to the initial production and filling operation.

The dispensing device as disclosed in the drawings and as discussed hereinafter was developed for a particular type of pill, namely nitroglycerin tablets, and was engineered specifically with regard to the problems encountered relative to the packaging and dispensing of this type of tablet. While the following discussion will be had with regard to these problems, it is understood, and indeed intended, that the dispensing device of the present invention is not limited to use with nitroglycerin tablets.

As will be appreciated, nitroglycerin tablets are used by individuals suffering from a heart condition and the need for dispensing thereof arises generally at a time when the individual is experiencing some sort of heart malfunction and is thus in severe pain. Thus, a dispenser for this type of pill must be reliable, efficient and easily operated, since when the need for the pill arises, time will be of the essence, with a few seconds being the difference between minor or severe heart damage, or even death.

An additional problem, which is encountered in the design of a dispenser for nitroglycerin tablets is that of moisture absorption, which tends to reduce the overall effectiveness of the pills. Therefore, in addition to being easily and efficiently operated, a dispensing device which is permanently attached to a nitroglycerin tablet container must provide a moisture barrier.

Still another problem which is encountered with prior art pill dispensers, although not particularly unique to nitroglycerin tablets, is that in dispensing the pills from a container wherein they are stored in random fashion (as opposed to pill packets) there is a tendency to damage the pills left in the container. This results due to the fact that the dispensing operation requires some form of relative movement between the various elements of the dispensing device. The present invention provides a construction wherein the change of damage to the pills remaining in the container is materially reduced, same being achieved without any loss of effectiveness in the dispensing operation.

Accordingly, as will be appreciated from the description to follow, it is a primary object of the present invention to provide a dispensing device which can be assembled to a randomly filled container as a cap assembly. The movel device of this disclosure is designed such that rotation through a relatively small arc, in either direction, will result in the dispensing of a pill, without danger of the dispensing device becoming fouled, or that any of the pills remaining in the container will be damaged. As the description hereinafter develops, other objects and advantages of the present invention will become apparent to those skilled in the art.

BRIEF DESCRIPTION OF THE DRAWINGS

FIG. 1 is an exploded perspective view of a pill container and one form of dispensing cap assembly according to the present invention;

FIG. 2 is a perspective view of the assembled container package, i.e. with the dispensing cap assembly in place, the overall package being in the upright position;

FIG. 3 is a fragmentary sectional view of the dispensing cap assembly mounted to the neck of a pill container, the entire assembly being in the inverted or dispensing position;

FIG. 4 is a sectional view taken along the line 4—4 of FIG. 3 illustrating the rotation preventing means employed in conjunction with the present invention;

DESCRIPTION OF THE ILLUSTRATED EMBODIMENT

Figure 5:
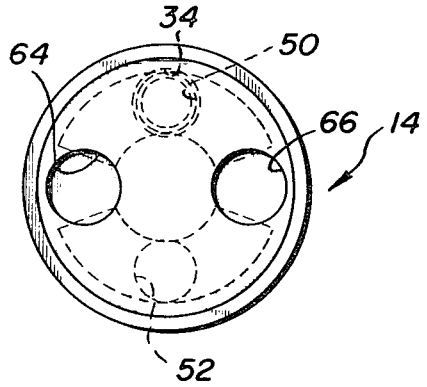
FIG. 5 is an end view of the dispensing cap assembly of FIGS. 1 and 2 illustrating the initial condition whereupon a pill is introduced into the rotor element of the assembly.

Referring now to the drawings, a pill container package embodying the dispensing cap assembly of the present invention is illustrated in exploded perspective in FIG. 1, while the assembled container package is shown in the upright condition in FIG. 2. Basically, the overall assembly, which is designated generally 10, includes a pill container or bottle 12 and a dispensing cap assembly 14 secured thereto. The container 12 is of generally standard design and includes a threaded neck portion 16 to which the dispensing cap assembly 14 is mounted. While an external type of mounting is shown, is should be noted that an internal arrangement could be employed, if desired.

At the time of initial packaging, a spacer or seal element 18 is mounted over the open mouth 17 of the thread neck 16 to provide a barrier or seal which prevents the pills stored within the container from absorbing excessive, damaging moisture. The seal or spacer element 18 serves an additional purpose, as will be explained with regard to FIGS. 3 and 4, in that it maintains the cap assembly 14 in a position relative to the container 12, such that the certain elements of the invention which provide a locking or anit-rotation function are out of engagement, until such time as an individual removes the space or seal 18 to open the container 12 preparatory to use.

The dispensing cap assembly 14 includes a cap member 20 which has an internally threaded end portion 22 engaged with the externally threaded neck 16 of the container 12, as shown in FIG. 3. In addition, said assembly 14 includes a rotor element 21 and a cover 23 which is non-rotatably secured to the cap member 20 and serves to maintain the rotor 21 in position on said cap member 20. As will be explained in detail hereinafter, it is rotation or relative movement of the rotor 21 with respect to the cover 23 and cap member 20 which will enable dispensing of the pills from the container package 10.

With continued reference to FIG. 3, it will be noted that the threaded portion 22 of cap member 20 is slightly enlarged with regard to the remainder of the bore thereof so as to provide an internal shoulder 24. This shoulder 24 is designed to abut against the top edge 26 of the neck 16, when the overall assembly is in the condition as illustrated in FIG. 3. It should be noted however, that as initially assembled at the factory, the spacer or seal 18 will be disposed intermediate shoulder 24 and top edge 26 of the container, thus producing a slight axial separation of the container 12 with respect to the cap member 20, from the condition as shown in FIG. 3.

With reference to FIGS. 1 and 4, it should be noted that the inner edge of the internally threaded portion 22 on cap member 20 is provided with a plurality of ratchet teeth 26. Correspondingly, the outer peripheral surface of the container 12 includes one or more similarly shaped ratchet lugs 28 formed thereon. When the disc or spacer 18 is positioned on the upper edge 26 of the neck portion 16, and the cap 20 is screwed into position thereon, the respective ratchet elements 26 and 28 will not be brought into engagement. As such, the entire dispensing cap assembly 14 can be freely roated in either direction.

When it is desired to render the overall package 10 operable for the dispensing of pills, the entire cap assembly 14 is unscrewed and the spacer or disc 18 is removed and discarded. The cap assembly 14 is then repositioned on the neck 16 of the container 12 and is screwed into position until such time as the upper edge 26 of said neck abuts the shoulder 24, the condition as shown in FIG. 3. As the relative position of the elements as shown in FIG. 3 is approached, the ratchet teeth 26 will be brought into engagement with the ratchet lugs 28, with the respective slope surfaces of each permitting rotation of the cap member 20 in a counterclockwise direction, as viewed in FIG. 4. Once the respective mating parts are fully seated, rotation in the clockwise direction, as viewed in FIG. 4, which would result in unscrewing of the cap assembly 14, is precluded by engagement of the respective abutment surfaces on the ratchet teeth 26 and ratchet lugs 28. As such, it can be seen that once the cap assembly is fully seated on the container 12, manipulation of the rotor 21 pursuant to dispensing can take place in either the clockwise or counter-clockwise direction without the danger of unscrewing or loosening the cap asssembly 14 relative to the container 12.

The prevention of loosening or unscrewing of the overall cap assembly 14 from the container 12 is important for several reasons. Quite obviously, should the cap assembly become unscrewed after removal of the spacer 18, there is a danger of spilling the pills. As an additional factor, however, were the pills stored in the container of the type which tend to lose their effectiveness upon the absorption of moisture, it is important to maintain a moisture barrier at all times. In this regard, the tolerances employed with regard to the threaded portion 16 and 22 are relatively large, so that should the cap become loose, a path for the ingress of moisture would be provided into the container via the threaded parts and past the upper edge 26 of neck 16. However, with the invention as disclosed, once the cap assembly 14 is fully seated on said container 12, a seal will be mounted at the shoulder 24 thereby sealing against the entry of moisture into the container along the path of the threaded portion 16–20.

Consideration would now be directed to the construction of the various elements of the cap assembly 14, with specific reference to FIGS. 1 and 3. In this regard, the cap member 20 is provided with an interior area or space designated generally 30 which is partially defined by a slope surface 32 terminating at a discharge opening 34. As can be appreciated, when the container package 10 is inverted, the slope surface 32 will direct pills toward the discharge opening 34 and to assist in this regard, a pair of guide flanges 35 may be provided on opposite sides of the opening 34.

Centrally disposed on the end of the cap member 20 opposite the threaded end 22 is an axially extending hub 36 which includes a non-circular bore 38. Rotatably mounted upon the hub 36 is the rotor element 21. The rotor 21 is maintained on the hub 36 by means of the cover member 23. In this regard, the cover member 23 includes a central post 40 of a non-circular shape corresponding to that of the bore 38, and being disposed within said bore 38. Due to the non-circular shape of bore 38 and post 40, it should be noted that the cover 23 and the cap member 20 are fixed against relative rotation, with the rotor 21 being free to rotate relative to both said cover 23 and cap member 20.

In order to fix the respective elements against axial separation, the bore 38 is provided with an inwardly directed, arcuate lip or protuberance 42 which is adapted to be disposed within an arcuate groove 44 formed in said post in snap-fit relation. When the snap-fit engagement is achieved, it can be appreciated that the rotor 21 will be held captive between the underside 46 of the cover 23 and the face surface 48 of the cap member 20. Quite obviously, the relative relationship of the lip 42 and groove 44 could be reversed, or some additional type of snap-fit arrangement could be employed, such as a C-ring or the like.

As an additional factor, it is preferred that the distance from the end surface of the hub 36 to the lip 48 be equal to or slightly greater than the distance from groove 44 to the underside surface 46 of the cover member. As such, when the elements are assembled as shown in FIG. 3, the cover 23 will be pulled axially toward the cap member and will be in tight sealing contact with the end surface of the hub 36, again to provide a moisture barrier. Also, it is preferred that the rotor 21 be sized such that when assembly is effected in the manner discussed, said rotor 21 will be in sealing engagement with the respective surfaces 46 and 48 of cover 23 and cap member 29, respectively. As the respective parts will preferably be molded from a plastic material, the parts can be maintained in close sealing engagement, without impairing the ability of the rotor 21 to rotate relative to cap member 20 and the cover 23. Thus, the elements are maintained in a condition wherein the interface between the respective elements is sealed against moisture, protecting the pills inside the container 12. Accordingly, the only possible path for moisture to enter the container 12, is by way of the various openings and their respective elements. As will be discussed hereinafter, the elements of the various embodiments are constructed, such that one or more of these openings will be sealed at all times, thereby preventing moisture from entering the container via the said openings.

Attention is now directed specifically to the rotor 21, as is best viewed in FIG. 1. In this regard, the rotor 21 includes a pair of diametrically opposed, pill receiving apertures 50 and 52. On both sides of the individual apertures 50 and 52, there are provided slopes ramp surfaces 54 which are separated by lands 56. The purpose for the sloped surfaces 54 and lands 56 will become apparent pursuant to the discussion of the operation of the dispensing cap assembly 14, in conjunction with FIGS. 5–10.

As an additional point, the rotor 21 also includes an annular, axially depending skirt 58 which overlies a portion of the cap member 20 and is thus movable relative thereto. Skirt 58 is provided with a pair of diametrically opposed, axially extending grooves or channels 60. The peripheral surface of the cap member 20 correspondingly has a pair of diametrically opposed lugs 62 which are engaged within said grooves 60 with a snap-fit, in the condition as shown in FIG. 3. The degree of engagement between the grooves 60 and lugs 62 is such that the rotor 21 can be easily moved, i.e. it is releasably fixed in position. The orientation of the grooves 60 and lugs 62 relative to the discharge opening 34 and the pill receiving apertures 50 and 52 is such that when these are engaged, one of the pill receiving apertures 50 or 52 will be in alignment with the discharge opening 34 of cap member 20, as shown in FIG. 3. This is what will terminate the initial position wherein a pill can move out of the discharge opening 34 into the recess provided by the aperture 50 or 52, preparatory to dispensing.

As can also be seen from FIG. 1, the cover member 23 is provided with a pair of diametrically opposed openings 64, 66 which are in fact the dispensing openings through which a pill exits the cap assembly 14. Keeping in mind that the cover 23 and the cap member 20 are fixed against relative rotation, it should be noted, as shown in FIG. 5, that the openings 64 and 66 are offset with respect to the discharge openings 34 and cap member 20. In the embodiment of FIGS. 1–10, now under discussion, the offset is on the order of 90°. Thus, in the initial condition of FIG. 3, the dispensing opening 64 and 66 in cover 21 will be offset 90° from said aligned openings 30 and 52 or 54. Accordingly, the wall surface 46 of the cover member 23 will underlie the aperture 50 and enable a pill to be received by said rotor 21.

Figure 6:
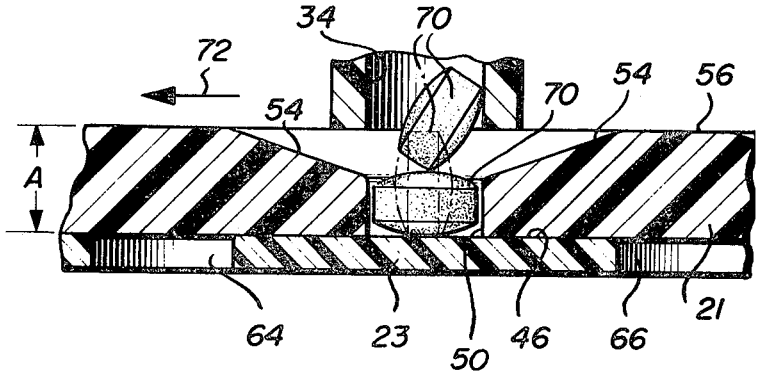
FIG. 6 is a schematic representation of the condition existing in FIG. 5, with the various elements illustrated in the plane of the drawings.
Figure 7:
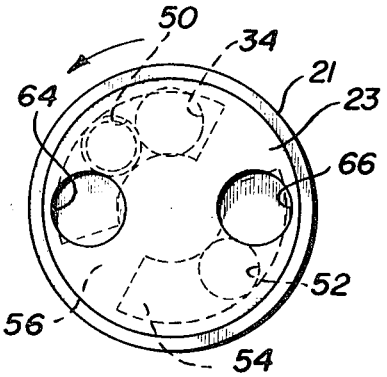
FIG. 7 is a view similar to FIG. 5, but illustrating an intermediate condition wherein a pill is being transferred toward the dispensing opening in the cover.
Figure 8:
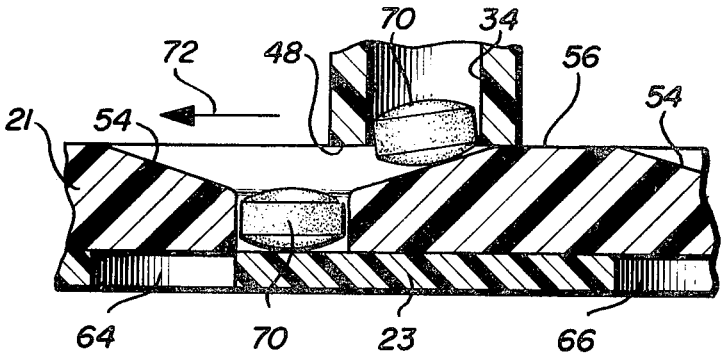
FIG. 8 is a view similar to FIG. 6 illustrating the condition of FIG. 7 in the plane of the drawings.
Figure 9:
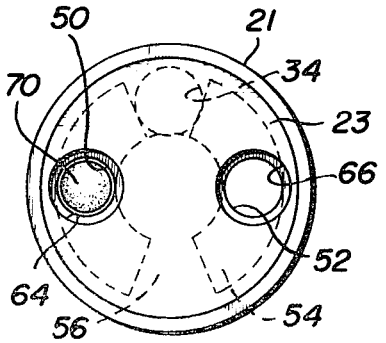
FIG. 9 is a view similar to FIGS. 5 and 7 illustrating the relative position of the elements with a pill about to be dispensed from said cap assembly.
Figure 10:
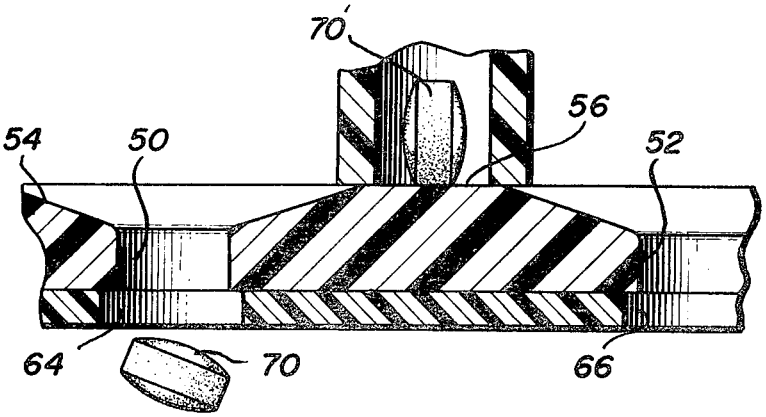
FIG. 10 is a view similar to FIGS. 6 and 8, illustrating the position of the elements at the point of dispensing, with the respective part being shown in the plane of the drawings.

The initial condition of FIG. 3 is also represented in FIGS. 5 and 6. With regard to sequential representations of FIGS. 5 and 10, it should be noted that FIGS. 5, 7 and 9, are end views of the cap assembly 14 representing the initial position (FIG. 5), an intermediate position, (FIG. 7), and the dispensing position (FIG. 9). Correspondingly, FIGS. 6, 8 and 10 are schematic representations of the elements of the dispensing cap assembly 14, illustrating, sequentially, the movement of the respective elements from the various conditions as shown in FIGS. 5, 7 and 9. In this regard, it should be noted that relative movement of the rotor 21 with respect to the cap 20 and cover member 23 is of course arcuate in nature. FIGS. 6, 8 and 10 merely illustrate schematically this movement in the plane of the drawings, and as such correspond to the adjacent FIGS. 5, 7 and 9.

Attention is now directed to the general operation of the dispensing cap assembly 14 which enables a pill to be dispensed effectively and efficiently, with but a small movement of the rotor 21 in either direction, and without danger of damage to the pills remaining within the container 12. Preparatory to the dispensing operation, the container 12 is inverted, and the pills 70 will slide down the slope surface 32 of the cap member 20 until they reach the discharge opening 34, wherein the first such pill 70 will pass out of said discharge opening into the aligned aperture 50 or 52 of the rotor 21. This initial condition is repeated in FIGS. 5 and 6, wherein one pill 70 is disposed in said aperture 50 while an additional or extra pill 70′ is partially received by said rotor aperture 50.

Digressing slightly, it should be recalled that we are dealing with a randomly filled container, that is the pills 70 are in no specific orientation. Accordingly, there are two general positions which the pills 70 will assume upon entry into the aperture 50. The first of these, is that as illustrated in full line in FIG. 6 wherein the pill rests upon its side within the aperture 50. The other such position, is that as illustrated in dotted outline, wherein the pill is disposed upon its edge. In order for the dispensing assembly 14 to operate efficiently, it must be able to handle both extremes of pill orientation. Accordingly, the effective depth of the pill receiving apertures 50 and 52, as measured by the thickness of A of the rotor member 21, must be sufficient to accommodate the pill 70 disposed on edge.

As will be appreciated, provision of pill receiving apertures 50 and 52 of sufficient depth to handle pill 70 in edgewise position, gives rise to an additional problem. That is to say, because of the effective depth A of the apertures 50 and 52, when a pill is received in the aperture as shown in FIG. 6, vis. on its side, an additional pill 70′ can also partially enter the area of aperture 50. The present invention provides means which assure that the rotor 21 can be rotated, without this additional pill 70′ preventing operation thereof and wasting valuable time. In this regard, the slope surfaces 54 will engage any extra or additional pills 70′, and which may enter the pill receiving area, as shown in FIG. 8 will cam said additional pill 70′ upwardly back into the discharge opening 34; note the condition as shown in FIG. 10. Due to the gradual slope of surfaces 54, this camming operation is achieved smoothly and without danger that the pill 70′ will prevent the necessary movement of rotor 21 or become damaged.

Accordingly, as the rotor 21 moves from the initial position as shown in FIG. 6, to the intermediate position of FIG. 7, pill 70 is carried along with the aperture 50 toward the dispensing opening 64. The extra or additional pill 70′ is cammed upwardly back into the discharge opening 34, by the slope surface 54, and thus will not hinder movement of the rotor 21. Rotor 21 is rotated until the aperture 50 is aligned with the dispensing opening 64 at which time the pill 70 will fall from the cap assembly 14. In this regard, it should be noted with regard to FIGS. 5 and 6, that the rotor 21 can be moved in either the clockwise or counter-clockwise direction, due to the opposed positioning of the openings 64 and 66. Thus, once the initial position is achieved the pill can be dispensed with only slight manipulation of the rotor 21, and there is no necessity that same be manipulated in any particular direction.

As an additional feature, keeping in mind the prior discussion concerning the provision of a barrier against the entry of moisture into the chamber 12, it should be noted that in the condition as shown in FIG. 6, both of the dispensing openings 64 and 66 are sealed by means of the undersurface of the rotor 21, while the pill receiving apertures 50 and 52 are sealed by the surface 46 of the cover member 23. As such, moisture cannot enter the container 12 through the various apertures in the cap assembly. In the dispensing condition, as shown in FIG. 10, wherein the pill receiving apertures 50 and 52 in the rotor are aligned with the respective dispensing apertures 64 and 66, the land 56 on the upper surface of the rotor 21 will overlie the discharge opening 34 to seal against the entry of moisture. During movement through the intermediate condition, FIGS. 7 and 8, lands 56 will be in engagement with surface 48 on the cap member 20, on opposite sides of opening 34, to afford an additional barrier. Thus, with regard to the relative positions of the cap assembly elements, as shown in FIG. 6 and 10, it can be seen that a moisture-proof barrier is maintained. While there will exist a path for entry of moisture into the container, during manipulation of the rotor 21 through the intermediate position, this condition will exist for only a short period of time, and will not be sufficient to result in damage to the effectiveness of the pills within the container 12.

Figure 11:
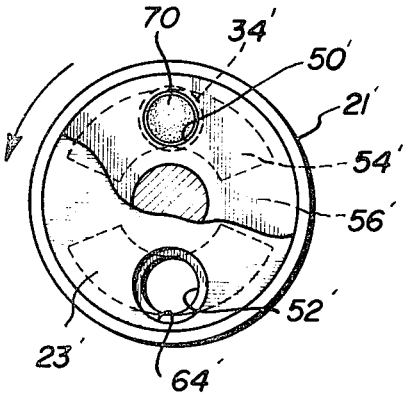
FIGS. 11–13 are end views of a modified form of cap assembly, illustrating sequentially the initial position of the rotor element, an intermediate position and the pill dispensing position.
Figure 12:
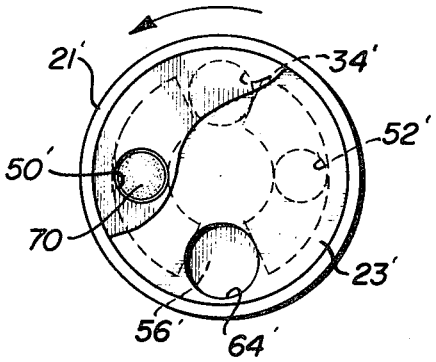
Figure 13:
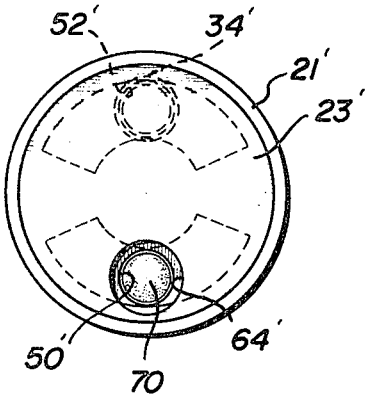
Figure 14:
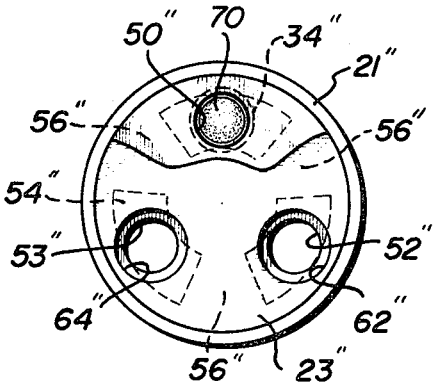
FIGS. 14–16 are views similar to FIGS. 11–13, but illustrating still another modified form of the invention.
Figure 15:
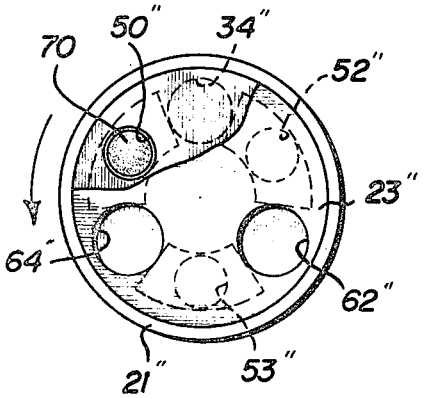

FIGS. 11–13 illustrate a modified form of the present invention, similar to that of FIGS. 1–10, but wherein only a single dispensing opening is provided in the cover member. FIGS. 14–15 illustrate still another form of invention, wherein the various openings in the cover member and the rotor are positioned at approximately a 120° offset. These two modifications will not be described, and for reference purposes, elements or features thereof similar to those already discussed will be designated by the reference character as used previously, with the addition of a prime (′) designation for FIGS. 11–13 and a double prime (″) designated for FIGS. 14–16.

Looking first to FIGS. 11–13, a sequential representation of the initial, intermediate and dispensing portion are shown. The primary difference between this embodiment and that previously described, is that the cover member 23′, shown partially broken away, includes but a single dispensing opening 64′ offset 180° relative to discharge opening 34′. The rotor 21′ is of generally similar shape to that as shown in FIG. 1, and the cap assembly 14′ will include lug and groove means similar to the lug 62 and groove 60 of the embodiment of FIG. 1 so that the rotor will be fixed in the position as shown in FIG. 11 or FIG. 13.

In moving from the initial position as shown in FIG. 11, through the intermediate position of FIG. 12, to the dispensing position of FIG. 13, wherein a pill 70 can exit the opening 64′, the rotor will rotate through approximately 180°. This rotation of course can be either in the clockwise or counter-clockwise direction, and will result in the additional pill receiving aperture 52′ being aligned with discharge opening 34′ in the cap member, a feature not obtainable with the previously discussed embodiment.

Of importance with regard to the embodiment wherein but a single dispensing opening 64′ is employed, is that the entry of moisture into the container by means of the discharge aperture 34′ is precluded at all times during operation, regardless of the relative position of the rotor 21′. In this regard, the engagement of the lands 56′ with the cap member surface, in conjunction with the fact that cover 23′ overlies the unfilled pill aperture 52′ provides a barrier against entry of moisture via opening 34′. Also, since the lands 56′ need not overlie discharge opening 34′, the width thereof can be reduced, and the slope of surfaces 54′ increased.

Figure 16:
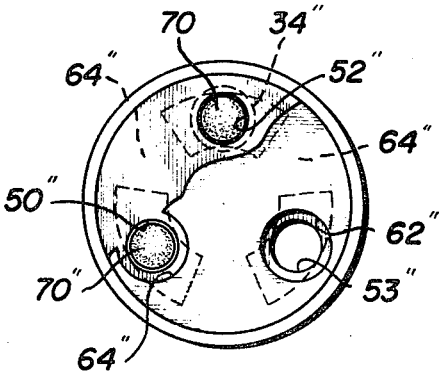

With the embodiment of FIGS. 14–16, the rotor 21″ is provided with three pill receiving apertures 50″, 52″ and 53′ disposed approximately 120° apart. Each pill receiving aperture has sloped surfaces 54″ on opposite sides thereof, which surfaces are separated by lands 56″. The cover member 23″ includes a pair of dispensing openings 64″ and 66″ which are offset from each other by 120°, and when said cover 23″ is keyed to the cap member, each dispensing opening will also be offset with regard to the discharge opening 34″, as shown in FIG. 14.

As will be noted from a comparison of FIGS. 14, 15 and 16, which as before illustrate the initial, intermediate and dispensing conditions, it can be seen that the rotor need only be rotated through an arc of 120° in order to effect dispensing of tablet 70, with one of said pill receiving apertures being positioned for receipt of a second pill from opening 34″. Also, the sealed condition will be maintained at all times by the lands 56″ and cover member 23″.

While the present invention has been described and illustrated in conjunction with three preferred embodiments, and with relation to specific problems encountered with dispensing of hydrophilic tablets, it is to be understood that the invention is not limited thereto. Applicants can foresee, and indeed would expect, those skilled in the art and equipped with the present disclosure to devise various modifications, alterations or substitutions for the specific structural features of the devices as described and illustrated. As such, it is Applicants' intent to cover any and all such modifications, alterations, etc. falling within the spirit and scope of the invention, as expressed by the claims appended hereto in accordance with the patent laws.

The invention is claimed as follows:

1. A dispensing device for pills or similar articles, which device is adapted to be operatively mounted on the neck of a container for said articles, said dispensing device including a cap member engageable with the neck of a container and including an axially facing end surface discharge opening formed therein; a rotor element mounted for unrestricted rotation relative to said cap member, and including a surface portion opposing the end surface of said cap member, and including at least one pill receiving aperture formed therein, said pill receiving aperture being disposed below said rotor element surface portion, with sloping surfaces formed on opposite sides of said pill receiving aperture in facing relation to said discharge opening and sloping from said aperture toward said rotor element surface portion, with at least one land formed on said surface portion separating said sloping surfaces, said sloping surfaces being of a substantial length, at least equal to the diameter of said pill receiving aperture; and a cover member in close overlying engagement with said rotor member, said cover member being non-rotatably engaged with said cap member and including at least one dispensing opening of said cap member; such that said pill receiving aperture in said rotor element can be aligned with said discharge opening to permit a pill to be disposed therein, with continued rotation of said rotor, moving said pill to said dispensing opening in said cover for dispensing thereof, with the disposition of said pill receiving aperture below said surface portion and said sloped surfaces providing sufficient space to accommodate a pill disposed on either its edge or its side, and serving to engage any additional pills that may be positioned proximate said aperture to force said pills upwardly and back into said discharge opening, upon movement of said rotor from said initial position to a position in alignment with said dispensing opening.

2. A dispensing unit as defined in claim 1, including means for forcing said rotor member into sealing engagement with said cap end surface, and said cover member into sealing contact with the opposing surface of said rotor member, and said dispensing opening in said cover member being arcuately offset with respect to the discharge opening in said cap member by a predetermined distance, which is such that upon alignment of said pill receiving aperture with said dispensing opening said land will overlie and seal said discharge opening.

3. A dispensing device as defined in claim 1, wherein said cover member and said cap include thereon means for locking said cover member to said cap against unwanted axial movement, such that said surface portion of said rotor member, including said land, is forced into tight sealing contact with the end surface of said cap, while said cover is in sealing contact with the opposite surface of said rotor, thereby providing a barrier against the entry of moisture into a pill container to which the device is attached.

4. A dispensing device as described in claim 3, wherein said cap includes a hub having a bore formed therein, which bore includes a lip extending rapidly inwardly thereof, said cover including a post received in said bore and having a groove formed therein into which said lip is received with a snap-fit engagement, the distance along said post from said groove to said cover being slightly less than the length along said hub from said open end thereof to said lip means, whereby when said lip means and said groove are engaged, said cover may flex sufficiently to permit said snap-fit engagement such that said cover will be in tight sealing engagement with an endface of said post and with said rotor member.

5. A dispensing device as defined in claim 3, wherein at least two pill receiving apertures are provided in said rotor member, each having sloped surfaces on opposite sides thereof, with lands separating said apertures and associated sloped surfaces, which lands engages the endface of said cap member to provide a moisture seal.

6. A dispensing device according to claim 1, wherein said rotor includes an axially extending outer peripheral sleeve which overlies an outer surface portion of said cap member, said sleeve and said cap member portion including means for releasably fixing the position of said rotor relative to said cap member wherein said discharge opening is aligned with said pill receiving aperture in said rotor member.

7. A dispensing device according to claim 1, wherein said cap includes an internally threaded end portion for engagement with the externally threaded neck of a pill container, said internally threaded end portion including ratchet means engageable with lug means formed on said container, such that when engaged said cap member can only be rotated in a direction producing movement toward said container, with unscrewing movement of said cap being precluded by said ratchet means.

8. A package assembly for pills or the like comprising a pill dispensing cap device in combination with a pill container, having a neck with an opening defined by a rim, said cap device being secured to the open neck of said container and including means for dispensing pills upon the rotation of an element thereof relative to said container, said cap device including an internally threaded segment engaged with an externally threaded neck of said container, and ratchet means on said cap device and said container which engage upon the seating of said cap device on the rim of the open neck of said container, and when engaged prevent rotation of said cap relative to said container in a selected direction required for unscrewing of said cap, said container including a spacer member positioned about the rim of said neck and engaged between said cap member and the rim of said container neck, to thereby prevent engagement of said ratchet means, such that only upon removal of said spacer member can said cap device be seated on said rim to bring said ratchet means into rotation limiting engagement, thereby precluding removal of the cap device.

9. A package assembly as defined in claim 8, wherein said spacer member overlies said open rim and is sealed thereto to provide an initial moisture barrier protecting the pill elements disposed interiorly thereof.

10. A package assembly as defined in claim 8, wherein said ratchet means comprise a plurality of inwardly facing ratchet teeth formed on said threaded segment, and one or more ratchet lugs formed on said container.

11. A package assembly as defined in claim 8, wherein said cap device comprises a cap member having an internally threaded end for engagement with said container, and including a discharge opening in the opposite end thereof; a rotor member rotatably mounted on said cap member and having at least one pill receiving aperture; a cover member overlying said rotor and being non-rotatably mounted relative to said cap member, said cover member overlying said rotor aperture and including at least one dispensing opening, such that upon rotation of said rotor with said package in the inverted position a pill will be disposed in said rotor aperture and will be transferred to said dispensing opening in said cover and will thus fall from said cap device.

* * * * *